United States Patent [19]

West

[11] 4,249,635

[45] Feb. 10, 1981

[54] FENCE CLIMBER

[76] Inventor: Wilfred H. West, 6520 Lucas Ave., Oakland, Calif. 94611

[21] Appl. No.: 48,018

[22] Filed: Jun. 13, 1979

[51] Int. Cl.[3] ..... A63B 29/04; E06C 9/04; E06C 7/08

[52] U.S. Cl. ..... 182/92

[58] Field of Search ..... 182/92, 206, 228

[56] References Cited

U.S. PATENT DOCUMENTS

| | | | |
|---|---|---|---|
| 1,613,716 | 1/1927 | Mylaeus | 182/92 |
| 3,259,209 | 7/1966 | Brown | 182/92 |
| 3,998,332 | 12/1976 | Lambertson | 182/92 |

FOREIGN PATENT DOCUMENTS

| | | | |
|---|---|---|---|
| 500655 | 11/1954 | Italy | 182/92 |

*Primary Examiner*—Reinaldo P. Machado
*Attorney, Agent, or Firm*—Lothrop & West

[57] ABSTRACT

A fence climber especially for use with an open-mesh cross wire, wire loop fence is made up of a rod bent upon itself into a half-circular arc near its center to provide a semi-loop that can engage and rest upon a fence wire. From the semi-loop, two legs extend at a slight divergence from each other, each leg having near one end an out-turned step extending about at a right angle to the adjacent leg and having a roughened upper surface to receive a shoe sole. The steps are about coplanar and are at an angle to the central, semi-loop. In some cases, each step is bent back upon itself to form a lower rod extending far enough toward the center to be engageable with the open mesh of the fence.

4 Claims, 6 Drawing Figures

FIG-4
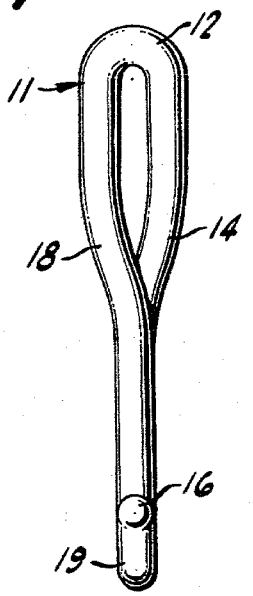
FIG-1
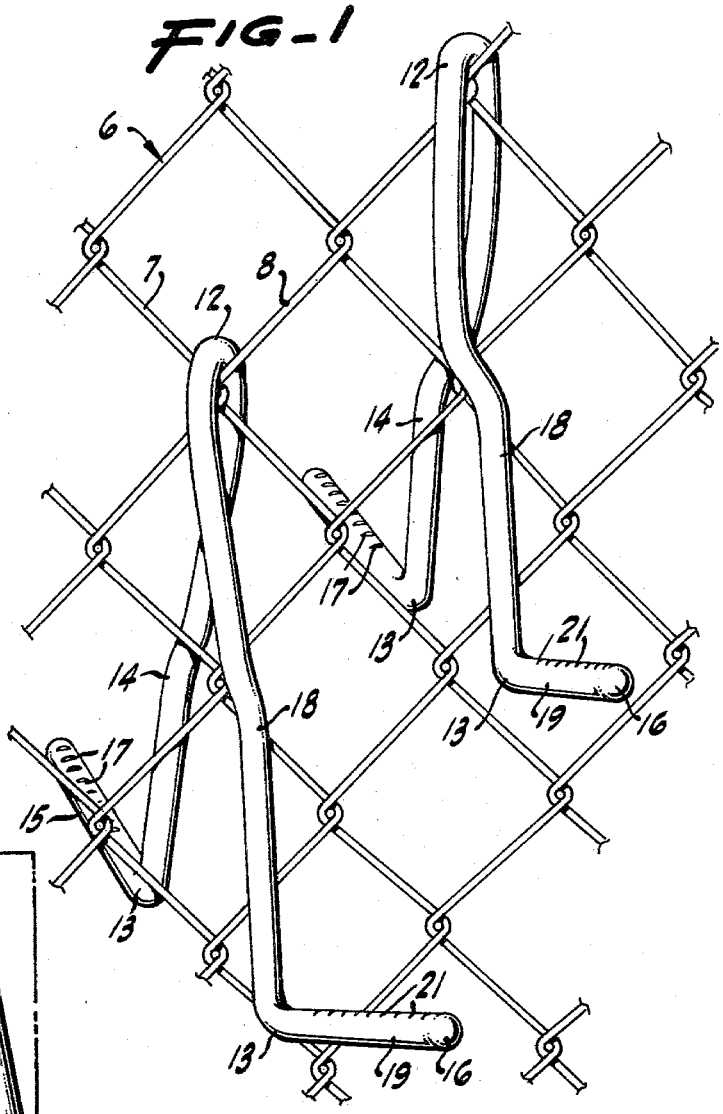
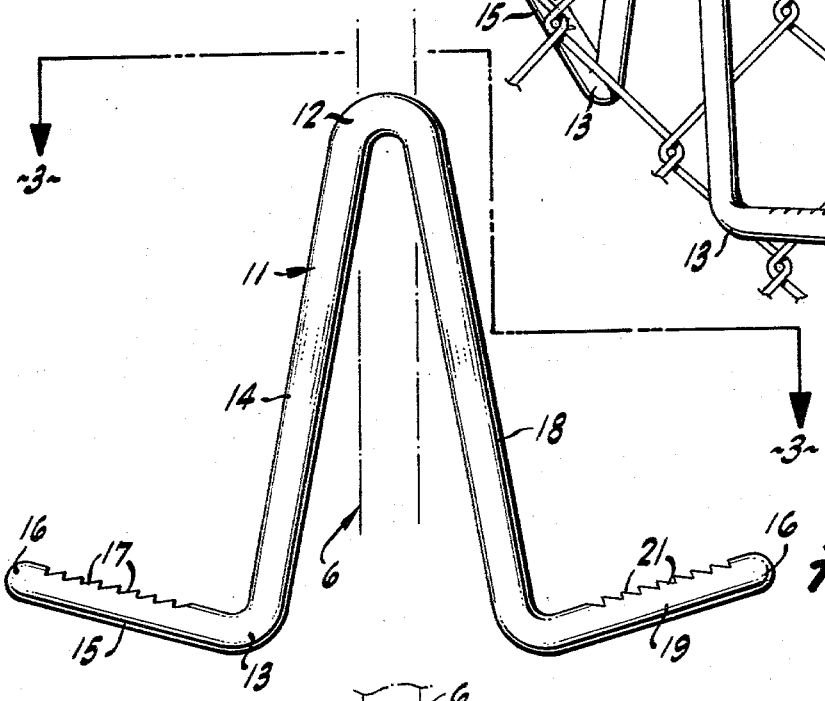
FIG-2
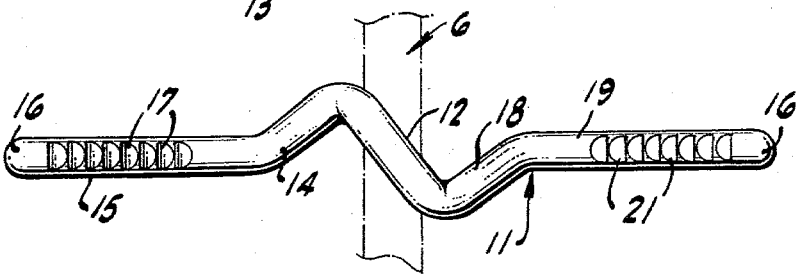
FIG-3

FENCE CLIMBER

BRIEF SUMMARY OF THE INVENTION

A wire rod is bent upon itself near the center into an approximately semi-circular arc to be able to engage and rest on the cross wires of an open-mesh fence, the rod extending outwardly and downwardly and finally near its ends being bent away from the center to afford a receiving step for the user's shoe sole. Each of the outwardly extending rod steps is preferably roughened to avoid slipping and may even be turned back upon itself toward the fence and be of a sufficient length to interengage with or between the wires of the fence.

BRIEF DESCRIPTION OF THE SEVERAL VIEWS OF THE DRAWINGS

FIG. 1 is a perspective view showing a wire mesh fence of a standard kind with which some of the fence climbers especially pursuant to the invention are in engagement.

FIG. 2 is an end elevation of one of the climbers as shown in FIG. 1 with a portion of the fence being shown in broken lines.

FIG. 3 is a view comparable to FIG. 2 but shows the device in a plan, the view being indicated by the line 3—3 of FIG. 2.

FIG. 4 is similar to FIG. 2, but shows the device in end elevation.

DETAILED DESCRIPTION

Figure 5:
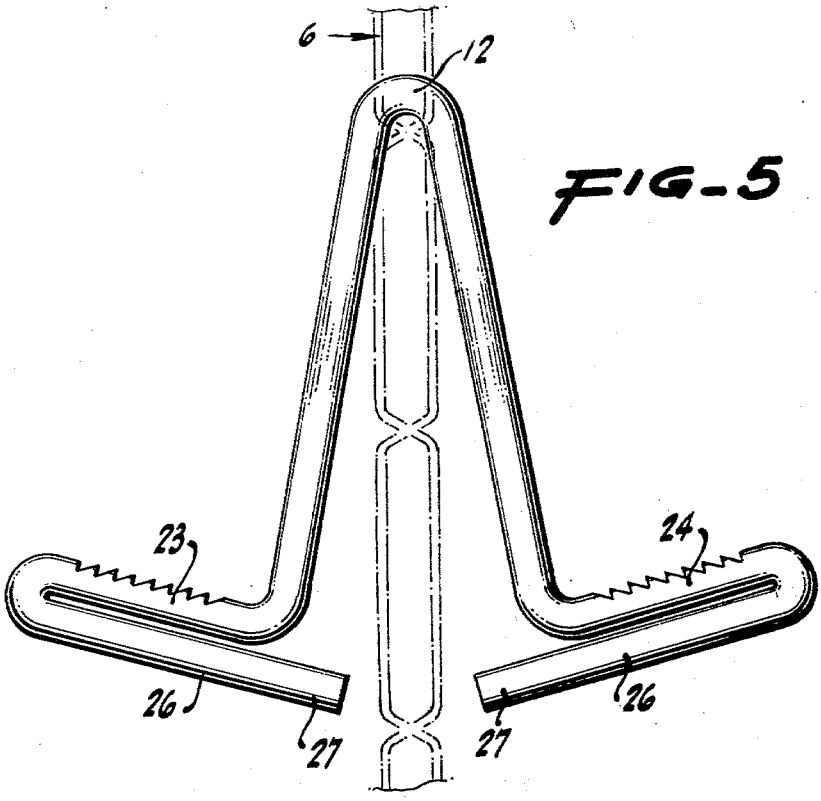
FIG. 5 is a view comparable to FIG. 2, but shows a modified form of fence climber in which the steps are augmented.

The present device is of a compact and light nature that can be carried by a user without any special difficulty and can be utilized by him whenever he encounters a relatively high, open-work mesh, wire fence that he wishes to scale. One or more of the fence climbers, just as normally carried by the user, are especially inserted through the mesh of the fence. Each is left generally symmetrically in engagement with the fence wires to provide steps or ladder-like rungs extending outwardly on both sides of the fence so that with at least one, and often with more than one, of the fence climbers the user can have a ready means for scaling one side of the fence and then descending on the other side of the fence. The climbers can easily be lifted off of the fence without difficulty when the use is terminated and can be carried away by the user. In one form of the device, each structure interengages with the fence in a couple of locations, so that the fence climber is held reasonably well in position and cannot swing to and fro to any great extent.

In a typical environment, as shown in FIG. 1, the device is customarily utilized in connection with a fence, generally designated 6, made up of interwoven wires 7 and 8 each of which forms a couple of sides of a square configuration. The wires are interlocked so that the squares cannot enlarge materially in any particular direction and affording a fence thickness much more than that of a single wire. The general plane of the installed fence, so formed, is vertical and is often supported on and by upright posts, not shown. Usually the height of the fence top is several feet from the ground, too much for an individual to get over without some assistance.

Pursuant to the invention, there is preferably provided a special climber that can be used with the fence as described and can readily be carried by the prospective user. Conveniently, while one climber is itself useful, it is customary to carry two or three or even four such climbers, so that fences of considerable height can be scaled and descended from.

In the present instance, the climber includes a rod 11 of customary light and strong material having, usually, a circular, transverse cross-section, the rod being bent near its center portion 12 to form a half-loop of a sufficient interior radius easily to hook over and rest upon the individual wires 7 or 8 or their junction. The rod 11 is substantially symmetrically bent on opposite sides of the half-loop 12. On the left side, for example, as seen in FIG. 2, the rod 11; that is, the leg 14 thereof, is provided with a bend 13 approximately at a right angle to form a step 15 out-turned therefrom away from the fence and ending in a rounded tip 16. Along the upper portion of the step, the rod is provided with serrations 17 to afford a good non-slip surface.

On the other side, the rod also has another leg 18 which is substantially a mirror image of the leg 14 and itself ends in a step 19 having a rounded tip and an upper serrated edge 21.

In addition to the configurations already described, and particularly as shown in FIGS. 3 and 4, the rod between the legs 14 and 18 and the step portions 15 and 19 and especially as shown in FIG. 3 is afforded a twist so that the plane of the half-loop 12 is approximately at forty-five degrees to the plane which contains the two steps 15 and 19. The purpose of this twist is so that the half-loop 12 can readily rest on the intersection of the fence wires 7 and 8 at a particular angle which best accommodates them, and yet leaves or positions (partly due to gravity) the steps 15 and 19 substantially coplanar and in a plane normal to or at right angles to the general plane of the fence itself.

In the use of this device, the prospective climber has two or three on his person and when he encounters the fence introduces each one through the fence mesh and over an appropriate part of the fence structure. The individual climbers are preferably spaced apart longitudinally from each other and at different elevations on the fence. In two or three steps the user can step or climb up one side of the fence, resting his weight on successive ones of the steps such as 19, for example, and then, having straddled the upper portion of the fence, can descend by putting his foot on the step or steps 15 extending from the other side of the fence. Having passed the fence, the user then detaches the various climbers from their interengagement with the fence loops and goes on to the next use.

As particularly shown in FIGS. 5 and 6, the structure as just described in connection with FIGS. 1 through 4 is duplicated except that it has an additional arrangement. Each of the steps 23 and 24 shown therein corresponds with the previous description but, instead of having a rounded end such as 16, is rather bent back upon itself in a half-turn to provide a lower portion 26 underlying the remainder of the structure. The lower portion 26 has an end 27 extending farther toward the center of the device to provide a projecting lug interengageable with the material of the fence. The swing to provide transverse shift and interengagement occurs automatically when there is weight imposed on one of the steps.

Figure 6:
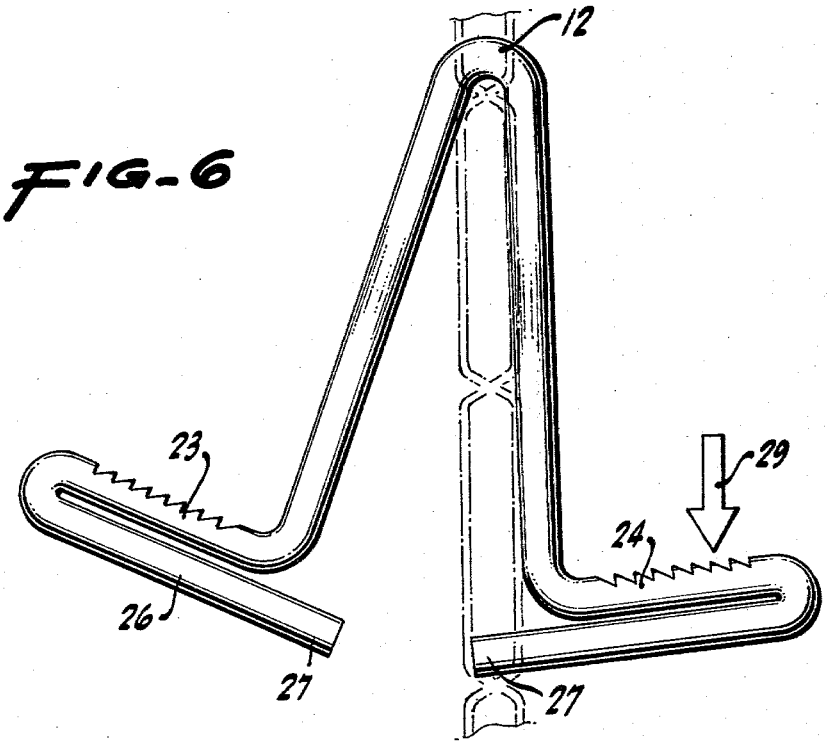
FIG. 6 is a view comparable to FIG. 5, but shows the fence climber as it is positioned when loaded on one side and having an extension of the step in interrelated engagement with the fence itself.

For example, as shown in FIG. 6, it is assumed that the step 23 is weightless and the weight of a user, represented by an arrow 29, is imposed on the step 24. This rotates the entire fence climber in a clockwise direction, as seen in FIGS. 5 and 6, and interengages the end 27 into and between the squared mesh of the fence. That interengagement limits movement of the fence climber in the general plane of the fence, so that it does not rotate more than a few degrees about the loop 12 as a fulcrum. This makes the climbing more nearly secure, not only on the ascent, but also on the descent. When the user goes off of the fence climber, and since the device itself is symmetrical, the balanced weight thereof tends to rotate the fence climber back from the position shown in FIG. 6 to the position shown in FIG. 5. Thus, when the climbing has been completed, the climber can easily be detached from the wire fence and carried by the user to the next fence.

I claim:

1. A fence climber for use with a fence that has a wire mesh construction comprising a rod near its center bent into an approximately half-circular arc merging with two substantially equal legs each of which continues into an out-turned step portion of an extent to receive a climber's foot, and each of said step portions being doubled back upon itself to form an inwardly projecting end extending inwardly beyond said leg associated therewith.

2. A device as in claim 1 in which said half-circular arc lies in a predetermined plane and said step portions lie in a common plane at an angle to said predetermined plane.

3. A device as in claim 2 in which both rod portions adjacent said arc are straight, both rod portions adjacent said step portions are straight, and said straight parts of each rod portion are connected by intervening inclined transitions.

4. A device as in claim 1 in which said legs digress from each other as they extend away from said half-circular arc, and each of said step portions extends from the associated one of said legs at approximately ninety degrees.

* * * * *